US011407558B2

(12) United States Patent
Kiolbasa

(10) Patent No.: US 11,407,558 B2
(45) Date of Patent: Aug. 9, 2022

(54) SHIPPING FRAME AND SHIELD

(71) Applicant: Charles G. Kiolbasa, Jr., Homer Glen, IL (US)

(72) Inventor: Charles Kiolbasa, Homer Glen, IL (US)

(73) Assignee: Charles G. Kiolbasa, Jr., Homer Glen, IL (US)

( * ) Notice: Subject to any disclaimer, the term of this patent is extended or adjusted under 35 U.S.C. 154(b) by 0 days.

(21) Appl. No.: 16/869,805

(22) Filed: May 8, 2020

(65) Prior Publication Data

US 2020/0277103 A1 Sep. 3, 2020

Related U.S. Application Data

(63) Continuation-in-part of application No. 16/377,301, filed on Apr. 8, 2019.

(60) Provisional application No. 62/657,957, filed on Apr. 16, 2018.

(51) Int. Cl.
*B65D 19/38* (2006.01)

(52) U.S. Cl.
CPC .. *B65D 19/385* (2013.01); *B65D 2519/00273* (2013.01); *B65D 2519/00542* (2013.01); *B65D 2519/00696* (2013.01)

(58) Field of Classification Search
CPC ..... B65D 19/385; B65D 2519/00273; B65D 2519/00542; B65D 2519/00696; B65D 85/005
USPC ..... 206/386–600
See application file for complete search history.

(56) References Cited

U.S. PATENT DOCUMENTS 3,533,502 A * 10/1970 Hansen ..... A47B 45/00 206/386
3,850,295 A * 11/1974 Black ..... B65D 85/06 206/304
4,151,925 A * 5/1979 Glassmeyer ..... B65D 88/005 206/386
4,660,904 A * 4/1987 Stephens ..... A47B 19/08 108/34
4,932,540 A * 6/1990 Pfeifer ..... A47F 5/04 211/193
5,163,676 A * 11/1992 Taub ..... A63B 63/083 248/412
5,318,313 A * 6/1994 Chapman ..... B60G 99/00 248/129
5,746,152 A * 5/1998 Huse ..... A47C 3/28 114/363
5,762,222 A * 6/1998 Liu ..... B65D 19/12 206/512
5,881,980 A * 3/1999 Knudson ..... A47B 9/20 248/188.8
6,267,255 B1 * 7/2001 Brush ..... A47F 5/112 206/386
6,299,113 B1 * 10/2001 Yamashita ..... A47B 9/20 248/161

(Continued)

*Primary Examiner* — Chun Hoi Cheung
(74) *Attorney, Agent, or Firm* — Cook Alex Ltd.

(57) ABSTRACT

An improved shipping frame for use with storage and/or transporting goods includes four corner posts and a top surface and a bottom surface. The corner posts comprise of telescoping leg sections whereby the smaller dimensioned section fits within the larger dimensioned section and can be locked at a particular height. A shield assembly comprises a rear shield and two side shields is affixed to the top section of the frame to brace any upper load therein.

17 Claims, 5 Drawing Sheets

(56) References Cited

U.S. PATENT DOCUMENTS

| | | | | |
|---|---|---|---|---|
| 7,304,839 | B1 * | 12/2007 | Burns | G06F 1/1601 108/38 |
| 7,992,738 | B2 * | 8/2011 | Gao | B65D 19/02 220/4.27 |
| 8,422,716 | B2 * | 4/2013 | Wetzel | F16B 7/14 381/362 |
| 8,495,961 | B2 | 7/2013 | Kiolbasa | |
| 8,573,136 | B1 | 11/2013 | Kokatsu et al. | |
| 8,770,114 | B2 * | 7/2014 | Kiskis | A47B 41/00 108/50.11 |
| 10,963,010 | B1 * | 3/2021 | Griffin | G06F 1/1603 |
| 2003/0006354 | A1 * | 1/2003 | Biles | F16M 13/02 248/354.1 |
| 2005/0188901 | A1 * | 9/2005 | Arai | B65D 19/44 108/53.1 |
| 2009/0057191 | A1 * | 3/2009 | Temple, Jr. | B65D 19/12 206/600 |
| 2016/0001438 | A1 * | 1/2016 | Buchner | B25H 1/0042 248/647 |
| 2016/0185486 | A1 * | 6/2016 | Baltz | A47F 3/14 206/600 |
| 2017/0349324 | A1 * | 12/2017 | Golanowski | B65D 11/1833 |

* cited by examiner

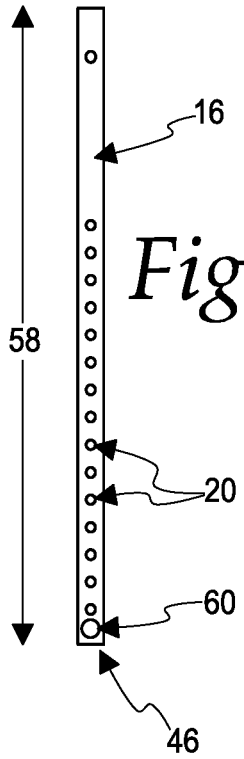
Fig. 6
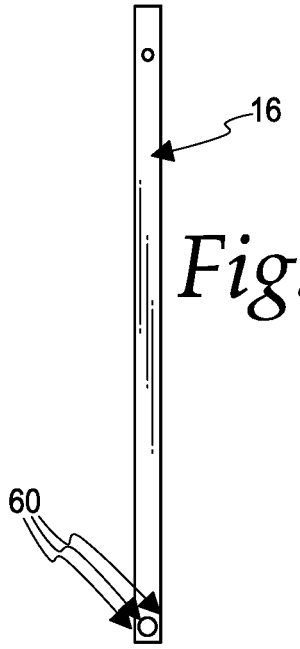
Fig. 7
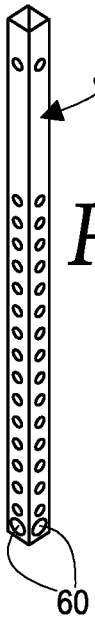
Fig. 8
Fig. 11
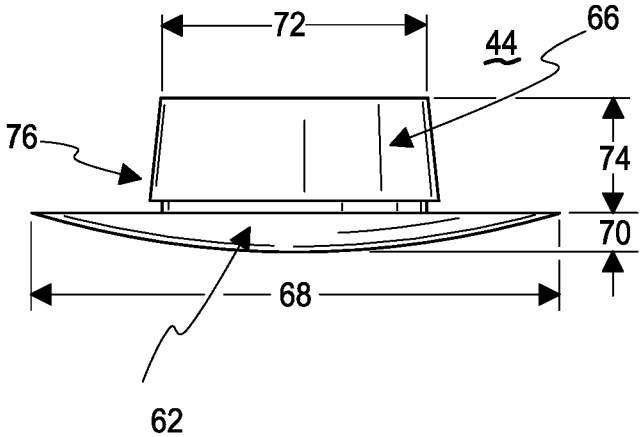
Fig. 9
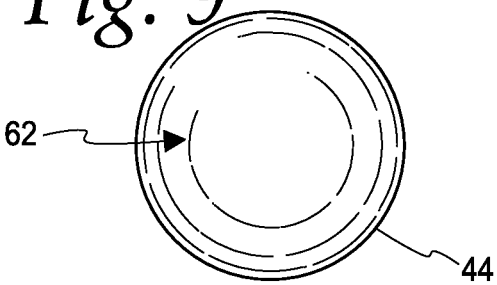
Fig. 10
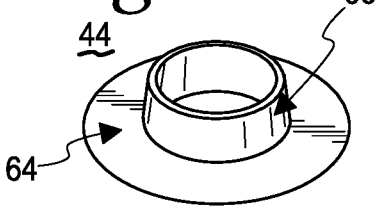

SHIPPING FRAME AND SHIELD

CROSS-REFERENCE TO RELATED APPLICATION

This application claims the benefit of U.S. Provisional Patent Application No. 62/657,957 filed Apr. 16, 2018, and U.S. Non-Provisional patent application Ser. No. 16/377,301 filed Apr. 8, 2019, both of which are hereby incorporated by reference in its entirety herein.

BACKGROUND OF THE INVENTION

I. Field of the Invention

The present disclosure relates generally to the field of shipping packages and objects, and more specifically to an improved shipping frame for the protection and maintenance of such goods during shipping, transport and storage.

II. Description of the Prior Art

So-called pallets have long been used to stack goods of all shapes and sizes for subsequent storage and/or shipment. These pallets have been conventionally constructed of rough wood, but may also be made of press-wood, plastic and aluminum. A wood pallet design typically allows for forklift movement of the pallets and their loads. Some allow forklift access from two opposing sides and therefore are said to provide two-way forklift access. Others are designed to allow four-way forklift access. Some have been made nestable and are accordingly able to be nested one on top of another for ease of stacking. Others have integrated sidewalls to become containers and may be further modified to be collapsible and stackable when not in use. Some are made especially for fifty-gallon drums, others especially for sheet-fed press runs, rolls of film, paper and the like, and still other for television display panels, etc. Some are less sturdy and for limited uses, while others are sturdier for extended uses. Indeed, a pallet can be designed to store and ship almost anything.

Regardless of the type of pallet design, whether conventional wood pallet or the more high-tech type designs, transport thereof inevitably results in the damage of their contents. This is especially true with many goods packaged in paperboard and small flute corrugated boxes and cartons, often referred to as folding and folded cartons. The goods packaged in such cartons include many consumer products, from medicines and pharmaceuticals, to foods such as breakfast cereal, pasta and chocolates, through toys, consumer electronics and automotive parts, to name a few.

In these boxes, many products are damaged when their boxes are crushed due to forklift damage and their own weight when over stacked. As a result, the need to provide an improved transportation system and method for more fragile loads (i.e. paperboard loads) has existed for many years. In particular, the need exists for ease of loading and unloading, as well as greater heights of loads without self-imposed crushing and the like.

One way to decrease damage is by the use of so-called shipping frames. A shipping frame essentially encloses the pallet and its contents through at least four corner posts and a top section. As such, these frames are stackable and accordingly provide a means to increase good shipment volume in an over the road trailer and/or other type of shipping vessel. However, the stability of shipping frames has always been questionable. Indeed, the adjustability of the height of such frames creates the instability within the telescoping legs. In particular, as the upper leg typically telescopes out of the lower leg to increase the height of the overall frame it becomes more unstable. As such, contents can once again be damaged and stacked frames have the propensity to topple due to this so-called wobble effect.

The present disclosure overcomes the instability and safety problems associated with numerous shipping frames. Accordingly, it is a general object of this disclosure to provide an improved shipping frame.

It is another general object of the present disclosure to provide a stable shipping frame.

It is another general object of the present disclosure to provide a safe shipping frame.

It is a more specific object of the present disclosure to decrease the amount of angular displacement between telescoping legs of a shipping frame.

It is yet another more specific object of the present disclosure to provide a spacer between telescoping legs of a shipping frame.

It is another more specific object of the present disclosure to provide a shield to brace upper loads of a shipping frame These and other objects, features and advantages of this disclosure will be clearly understood through a consideration of the following detailed description.

SUMMARY OF THE INVENTION

According to an embodiment of the present disclosure, there is provided a shipping frame for the protection of goods including outer post sections coupling a top to a bottom section. The post sections include inner and outer leg portions dimensioned to provide a gap therebetween and allow the inner leg to telescope within the outer leg. A locking assembly locks the posts at the chosen height and a shield assembly attached to the top section having a rear, a left and a right shield for protecting a load positioned on the top section.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which:

FIG. 6 is an enlarged side view of an upper leg portion of a shipping frame according to the principles of an embodiment of the present disclosure.

FIG. 7 is a frontal view of the upper leg portion of FIG. 6.

FIG. 8 is a perspective view of the upper leg portion of FIGS. 6 and 7.

FIG. 9 is a top plan view of the spacer of a shipping frame according to the principles of the present disclosure.

FIG. 10 is a perspective view of the spacer of FIG. 9.

FIG. 11 is an enlarged side view of the spacer of FIG. 9.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Figure 2:
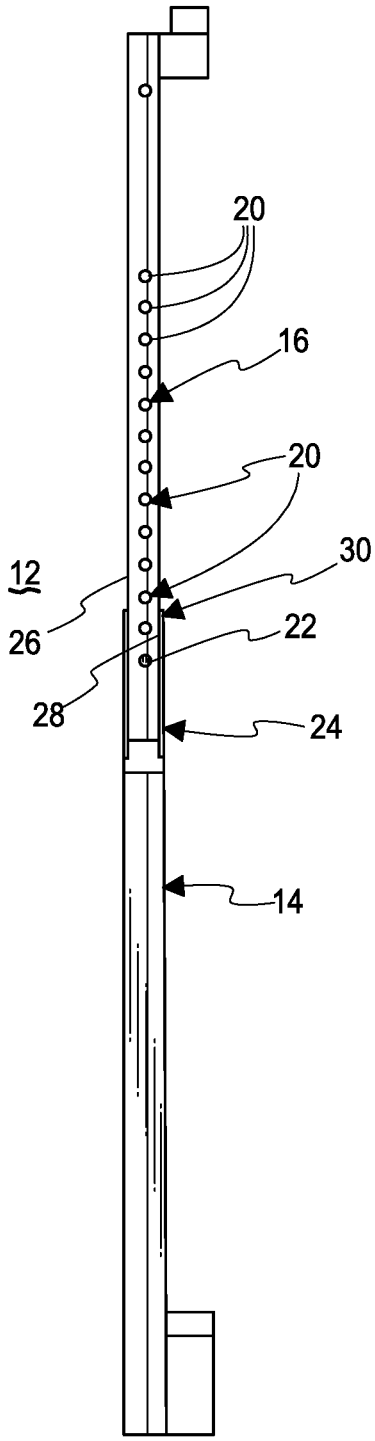
FIG. 2 is an enlarged elevated cross-sectional side view of a leg of the shipping frame of FIG. 1.
Figure 1:
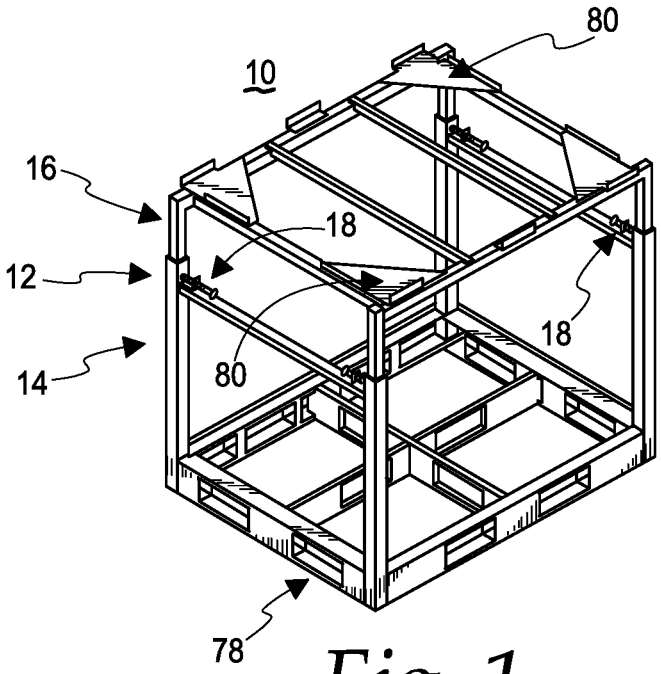
FIG. 1 is a perspective view from above a corner of an exemplar shipping frame which can be improved according to the principles of an embodiment of the present disclosure.

FIG. 1 illustrates an adjustable height shipping frame 10 having four telescoping leg members 12 each having a lower outer leg 14 and a smaller dimensioned upper inner leg 16. A locking pin assembly 18 or the like positions and locks the height of the upper leg 16 relative the lower leg 14 via use of positioning holes, see FIG. 2. Here, in FIG. 2, the leg is in the fully extended position with the pin 22 in the bottom most hole. Since the legs are made of sheet metal or square tubing, there is a sizable gap 24 needed to allow the legs to adjust by sliding the upper leg 16 into the lower leg 14, as well as to allow for manufacturing tolerances.

Figure 3:
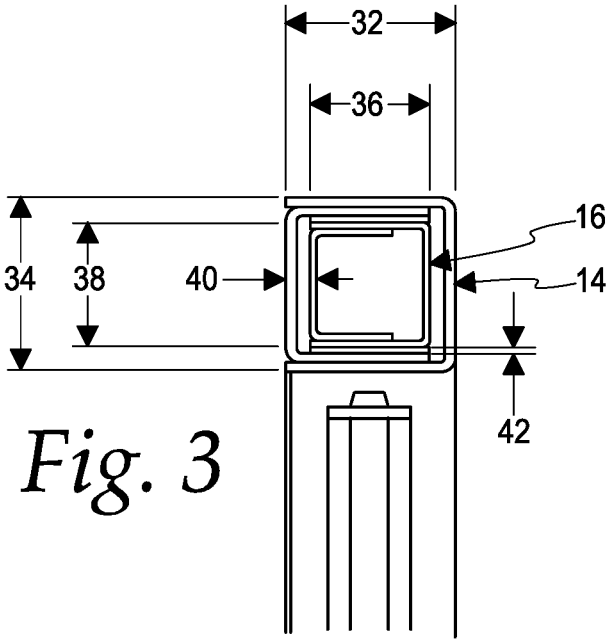
FIG. 3 is an enlarged cross-sectional top plan view of a leg of the shipping frame of FIG. 1.

However, this gap 24 allows the leg to pivot on the locking pin 22 until the outside 26 of the upper leg 16 contacts the inside 28 of the lower leg 14, typically near the top 30 of the lower leg 14, thereby creating the aforementioned instability and so-called wobbling effect. This gap 24 is best shown in the cross-sectional view of FIG. 3. In particular, the lower base leg 14 has a cross-sectional length 32 and height 34, while the upper top leg 16 has a cross-sectional length 36 and height 38. It is the clearance between the difference of the lengths and heights of the two leg sections that create this gap 24. In particular, the difference between the lengths (32 and 36) create the front gap 40, and the difference between the heights (34 and 38) create the side gap 42.

Placing a spacer (or button or the like) 44 near the bottom 46 of the upper leg 16 reduces the gap 24 between the upper 16 and lower 14 legs which reduces the angular displacement and so-called wobble. The spacer may take the form of a button that engages a hole in the upper leg 16, or it may frictionally engage the gap between the upper and lower leg, or any other coupling/engagement can be used so long as the spacer 44 fills some or all of the gap. This spacer allows the legs to function smoothly and decreases, and in some cases eliminates, the upper leg wobble.

Figure 4:
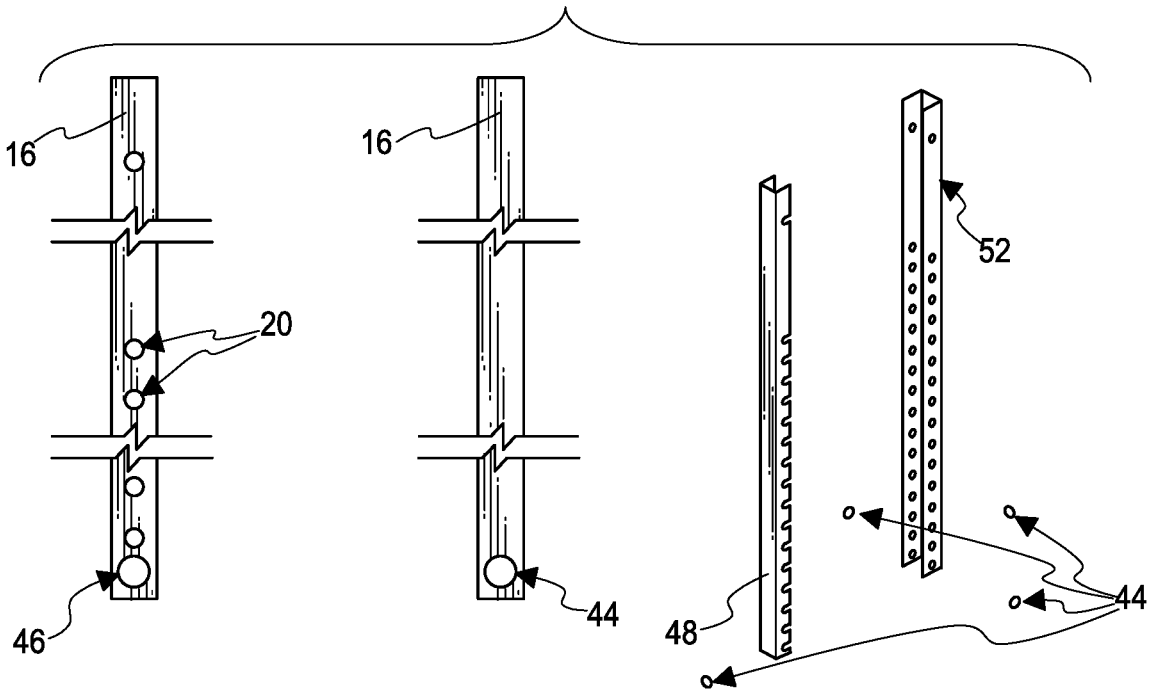
FIG. 4 comprises multiple views of the upper leg portion of a shipping frame according to the principles of an embodiment of the present disclosure.
Figure 5:
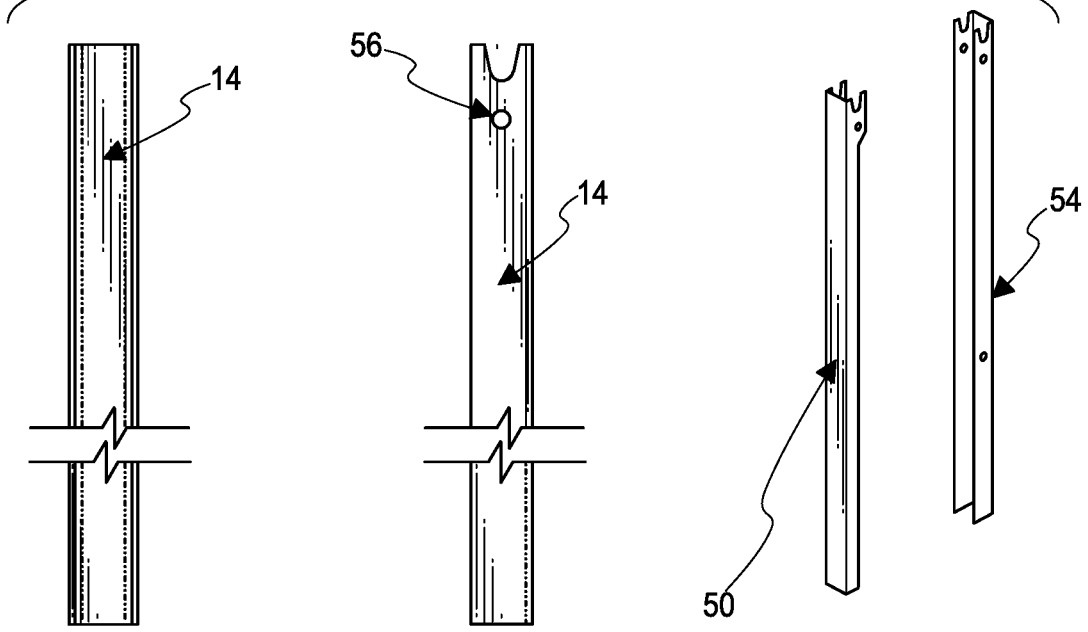
FIG. 5 comprises multiple views of the lower leg portion of a shipping frame according to the principles of an embodiment of the present disclosure.

The construction of the legs of this embodiment is best shown in FIGS. 4 and 5, wherein FIG. 4 shows multiple views of the upper leg 16 and FIG. 5 shows multiple views of the lower leg 14. In particular, both the upper 16 and lower 14 legs are each made of inner (48, 50) and outer (52, 54) portions, respectively, that come together to form the legs. The upper leg is shown with multiple positioning holes 20 to change the height of the telescoping legs before locking them in place using the pin hole 56 of the lower leg. However, it will be understood that the legs may have cross-sectional shapes in forms other than square. For example, the legs may have circular cross-sections. However the legs may be shaped, it is the telescoping design of one dimensioned smaller than the other that enables the telescoping feature during height adjustment.

The enlarged upper leg views of FIGS. 6-8 show the positioning of the spacers 44 in relation to the side (FIG. 6), front (FIG. 7) and perspective (FIG. 8) view of the upper leg 16. In this embodiment, and referring first to FIG. 6, multiple positioning holes 20 are located along the length 58 of the upper leg to enable adjustment of the height of the legs, and thus the frame, when locked into the pin 22 of the locking pin assembly 18 engages the pin hole 56 of the lower leg 14. Near the bottom 46 of the upper leg 16 is a hole 60 for the spacer 44 to engage. FIGS. 7 and 8 also depict the locations of these holes (20 and 60) along the upper leg 16.

The button 44 of this embodiment is best shown in FIGS. 9-11. FIG. 9 is a top plan view of the button illustrating a top surface 62 of the button 44. FIG. 10 is a bottom perspective view illustrating the underside 64 of the button and the lower leg button hole 60 engaging portion 66 thereof. While FIG. 11 is a side view illustrating the dimensions of the button 44. In particular, the top surface has a diameter 68 and a height 70. It is this height 70 that fills some or all of the gaps (24, 40 and 42) created by the clearance between the dimensions of the inner and outer legs. By way of example, if four buttons 44 are used on each leg (one on each side of the square leg embodiment), then the height 70 of the button would be approximately ½ of the front gap 40 as well as ½ of the side gap and would generally fill the gap 24. The hole engaging portion 66 of the button 44 also has a diameter 72 and a height 74. The hole engaging portion is shown angled 76 so as to frictionally engage the lower leg button hole 60.

The embodiment as shown includes a small (plastic) button 44 placed on each side of the square bottom of the upper leg 16. This small material allows the legs to translate without locking up. Indeed, if the spacer were to be used throughout the entire length of the gap, the surfaces would rub and be prone to jam and possibly locking because, due to manufacturing tolerances, neither the upper leg 16 nor the lower leg 14 are perfectly straight. It will be appreciated however, that the spacer of the present disclosure is not limited to such a button 44 and button hole 60 design. As previously discussed, it will also be appreciated that the telescoping legs are not limited to a square configuration. They may be tubular or otherwise. So long as the spacer fills some of the gap formed between the upper and lower leg and decreases and/or eliminates the angular displacement thereof it can be of multiple embodiments and/or design alternatives.

It has already been found that the principles as taught in the present disclosure have indeed produced successful results during the transport of goods. Indeed, and referring back to FIG. 1, multiple shipping frames 10 have been adjusted to stack on top of one another within a tracker trailer during over the road transport. Specifically, when the bottom section 78 of a first frame is positioned on the top section 80 of a second frame, the spacers 44 within the telescoping legs provide the necessary stability to the legs which is then translated to the stacked frames thereby keeping the goods contained within safe and undamaged.

Figure 12:
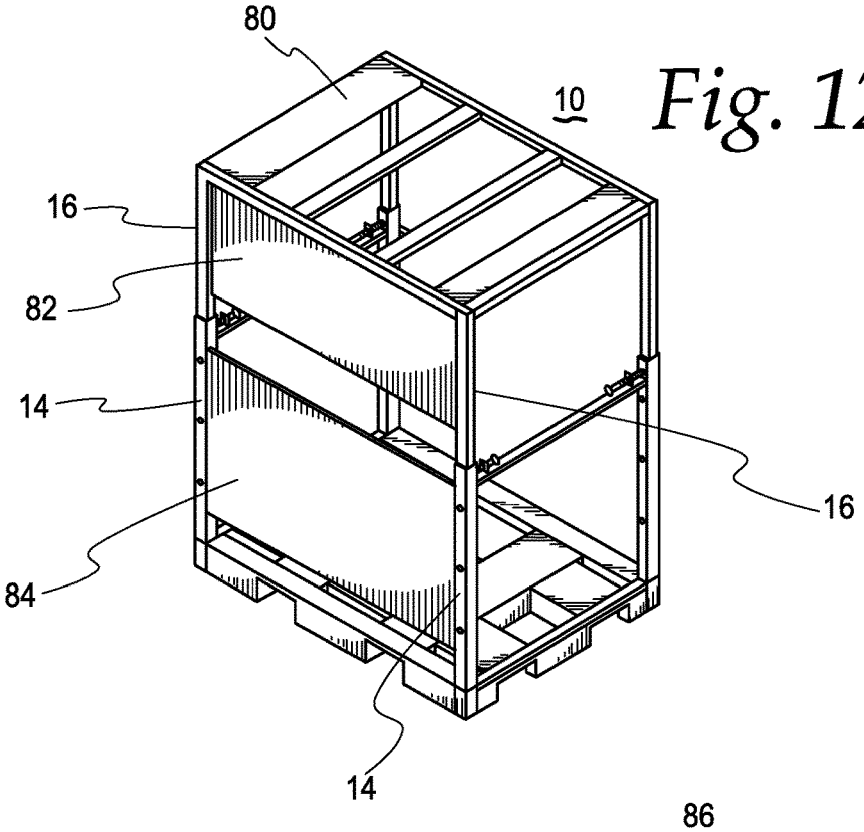
FIG. 12 is a rear perspective view from above a corner of an exemplar shipping frame according to another embodiment of the present disclosure.

Another embodiment of the improved shipping frame 10 is shown in FIG. 12. In particular, upper shield 82 and lower shield 84 are included to provide additional support to protect and/or brace any loads within the frame 10. These shields are affixed to the rear upper legs 16 and the rear lower legs 14, respectively. Such affixation may be nuts and bolts, rivets, screws, clips, or the like.

Figure 13:
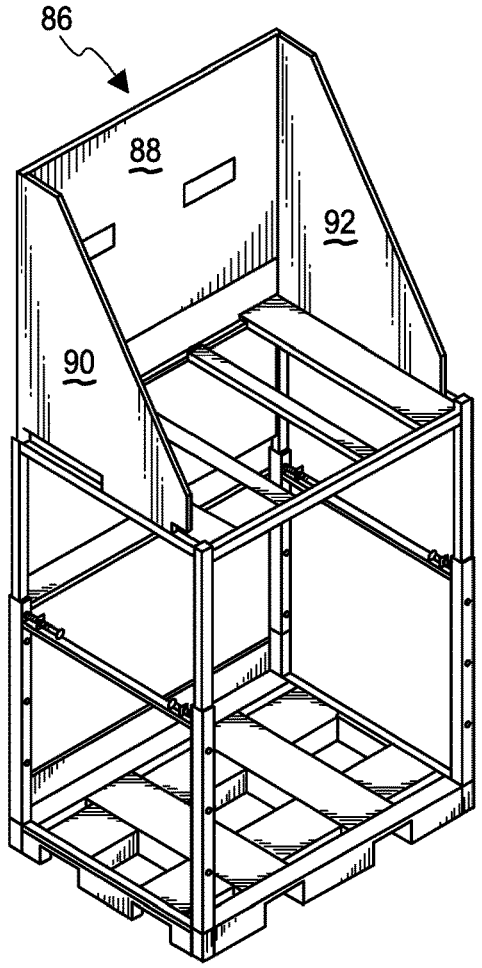
FIG. 13 is a front perspective view from above a corner of an exemplar shipping frame according to another embodiment of the present disclosure.
Figure 14:
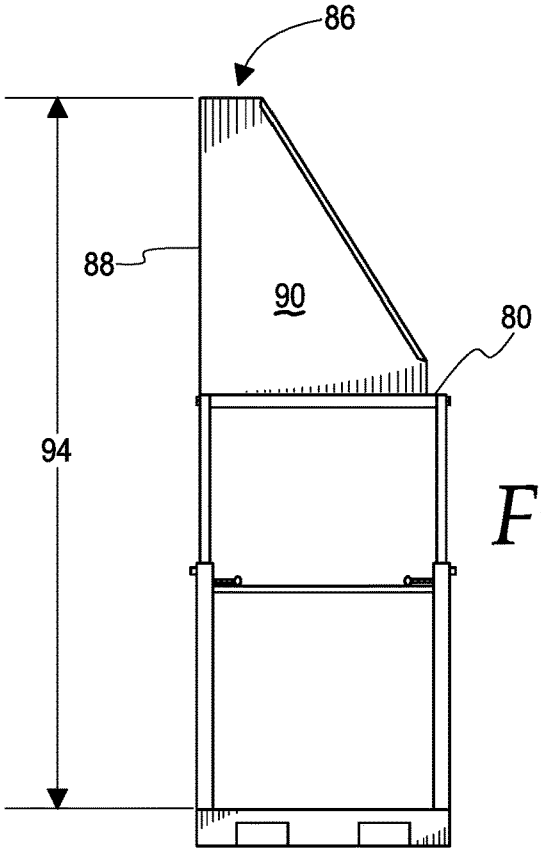
FIG. 14 is a side view of the shipping frame of FIG. 13.

Additional shields forming a shield assembly 86 are shown in FIGS. 13 and 14. In particular, this shield assembly 86 protects and/or braces any loads positioned on top of the frame and includes a back or rear shield 88, a left shield 90 and a right shield 92. The back shield 88 may be in the form of a rectangle while the side shields (90 and 92) may be in the form of a triangle. The back and sides form a rigid assembly that is affixed to the top section 80 of a frame 10. Such affixation may be nuts and bolts, rivets, screws, clips, or the like. As the frame 10 includes adjustable height telescoping legs, the total height 94 of the combination of the frame and the assembly is also adjustable.

Figure 15:
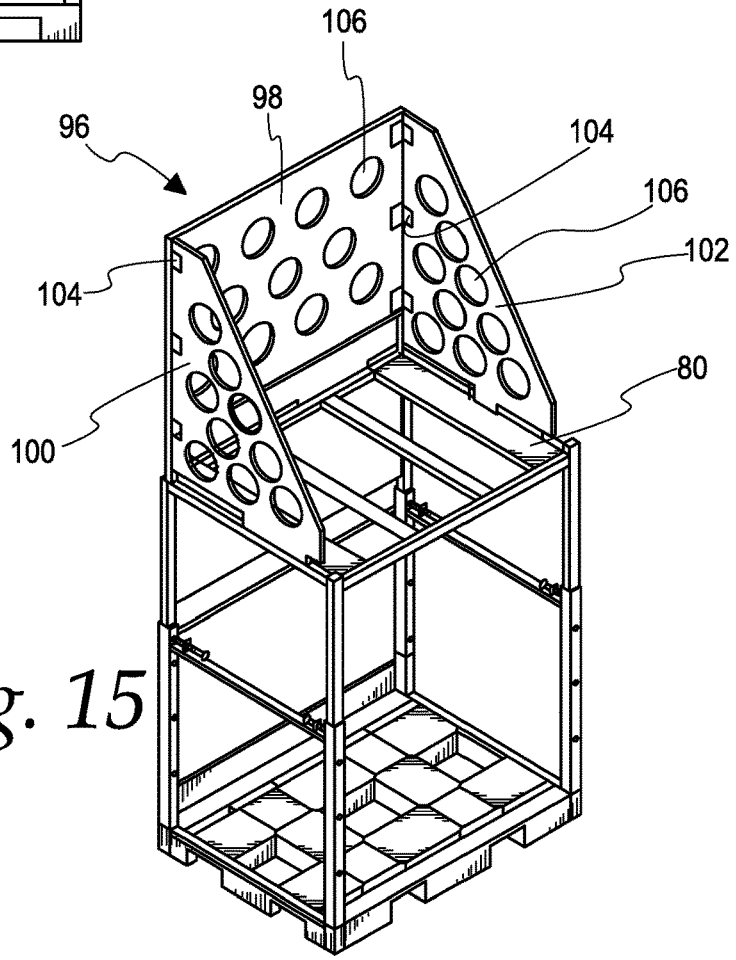
FIG. 15 is a front perspective view from above a corner of an exemplar shipping frame according to another embodiment of the present disclosure.

An alternate embodiment of the shield assembly 96 is foldable and easily detachable from the frame. In particular, this foldable assembly 96 as shown in FIG. 15 includes a rear shield 98, left shield 100 and right shield 102. This assembly includes hinges 104, or the like to allow the shields to fold relative to one another. The shields of this assembly 96 may also include holes or other voids to reduce weight and better facilitate attachment and detachment from the frame.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. An adjustable shipping frame for the protection of goods, said adjustable shipping frame comprising:

(A) four corner posts coupling a top section to a bottom section said four corner posts comprising:

(i) an upper inner leg portion comprising:

(a) a first inner portion;

(b) a second inner portion; and (c) a plurality of position holes, wherein said upper inner leg has a first dimension; and (ii) a lower outer leg comprising:

(a) a first outer portion;

(b) a second outer portion; and (c) a pin hole, wherein said lower outer leg has a second dimension;

wherein said first dimension is smaller than said second dimension and is sized that provides a gap to allow said upper inner leg to telescope in and out of said lower outer leg;

wherein said first outer portion and said second outer portion are u-shaped channels and combined such that said first outer portion fits inside said second outer portion to form said lower outer leg, wherein said lower outer leg is substantially rectangular in cross section, (iii) a locking assembly configured to lock said inner upper leg at a position within said lower outer leg via a pin placed through said pin hole and one of said plurality of position holes; and (B) a shield assembly attached to and positioned on top of said top section of said adjustable shipping frame comprising:

(i) a rectangular-shaped rear shield;

(ii) a triangular-shaped left shield; and (iii) a triangular-shaped right shield, said shield assembly configured for protecting a load of goods positioned on top of said top section.

2. The adjustable shipping frame of claim 1 wherein said rectangular-shaped rear shield, said triangular-shaped left shield, and said triangular-shaped right shield are foldable.

3. The adjustable shipping frame of claim 1 wherein said shield assembly further comprises:

(iv) a first hinge connecting said rectangular-shaped rear shield to said triangular-shaped left shield; and (v) a second hinge connecting said rectangular-shaped rear shield to said triangular-shaped right shield.

4. The adjustable shipping frame of claim 1 wherein said adjustable shipping frame includes at least one lower shield attached to two of said corner posts.

5. The adjustable shipping frame of claim 1 further including a spacer positioned within said gap to stabilize said upper inner leg when in a locked position.

6. The adjustable shipping frame of claim 5 wherein said upper inner leg and said lower outer leg are generally rectangular in cross-section.

7. The adjustable shipping frame of claim 6 wherein said spacer is a first button.

8. The adjustable shipping frame of claim 7 wherein said first button is configured to go in a first button hole in said upper inner leg.

9. The adjustable shipping frame of claim 8 further comprising a second button configured to go in a second button hole in said upper inner leg, wherein said second button hole is located on a different side of said upper inner leg than said first button hole.

10. The adjustable shipping frame of claim 8 wherein said first button has an angled hole engaging portion.

11. The adjustable shipping frame of claim 1 wherein said rectangular-shaped rear shield comprises a plurality of holes to reduce weight.

12. The adjustable shipping frame of claim 1 wherein said first inner portion, said second inner portion are u-channel beams.

13. The adjustable shipping frame of claim 1 wherein said adjustable shipping frame is configured to be stacked on a second adjustable shipping frame, wherein said second adjustable shipping frame does not include a shield assembly.

14. The adjustable shipping frame of claim 1 wherein said upper inner leg is made of sheet metal.

15. An adjustable shipping frame, said adjustable shipping frame comprising:

(A) four corner post coupling a top section to a bottom section, said four corner post each comprising:

(i) an upper inner leg comprising:

(a) a first inner portion;

(b) a second inner portion;

(c) a plurality of position holes;

(d) a first button hole;

wherein said upper inner leg has a first dimension; and (ii) a lower outer leg comprising:

(a) a first outer portion;

(b) a second outer portion; and (c) a pin hole, wherein said lower outer leg has a second dimension;

wherein said first dimension is smaller than said second dimension and is sized that provides a gap to allow said upper inner leg to telescope in and out of said lower outer leg;

wherein said first outer portion and said second outer portion are u-shaped channels and combined such that said first outer portion fits inside said second outer portion to form said lower outer leg, wherein said lower outer leg is substantially rectangular in cross section, wherein said first inner portion, said second inner portion are u-channel beams, wherein said upper inner leg is generally rectangular in cross-section, (iii) a locking assembly configured to locks said inner upper leg at a position within said lower outer leg via a pin placed through said pin hole and one of said plurality of position holes;

(B) a shield assembly attached to and positioned on top of said top section of said adjustable shipping frame comprising:

(i) a rectangular-shaped rear shield;

(ii) a triangular-shaped left shield; and (iii) a triangular-shaped right shield, said shield assembly configured for protecting a load of goods positioned on top of said top section;

(C) a lower shield attached to two of said corner posts; and (D) a first button with an angled hole engaging portion, wherein said first button is positioned in said first button hold and extends into said gap to stabilize said upper inner leg.

16. The shipping adjustable frame of claim 15 wherein said rectangular-shaped rear shield comprises a plurality of holes to reduce weight.

17. A shipping system comprising:

(A) the shipping adjustable frame of claim 1;

(B) a pallet; and (C) a plurality of corrugated cartons located on said pallet.

* * * * *